United States Patent [19]

Bolie

[11] Patent Number: 4,939,419

[45] Date of Patent: Jul. 3, 1990

[54] RFQ ACCELERATOR TUNING SYSTEM

[75] Inventor: Victor W. Bolie, Albuquerque, N. Mex.

[73] Assignee: The United States of America as represented by the United States Department of Energy, Washington, D.C.

[21] Appl. No.: 180,498

[22] Filed: Apr. 12, 1988

[51] Int. Cl.[5] ..... H05H 9/02; H01J 25/10

[52] U.S. Cl. ..... 315/5.41; 315/5.42; 313/361.1; 165/18

[58] Field of Search ..... 315/5.41, 5.42, 5.43, 315/5.23, 32; 313/22, 24, 35, 359.1-362.1; 328/233; 364/502, 510, 557; 165/18, 30, 12

[56] References Cited

U.S. PATENT DOCUMENTS

| | | | |
|---|---|---|---|
| 2,956,201 | 10/1960 | Neal et al. | 315/5.41 |
| 3,449,618 | 6/1969 | Gallagher | 315/5.41 |
| 3,888,303 | 6/1975 | Skala | 165/18 X |
| 3,935,552 | 1/1976 | Hutcheon | 333/234 X |
| 4,146,084 | 3/1979 | Hinkle | 165/18 X |
| 4,191,172 | 3/1980 | Walch, Jr. et al. | 165/18 X |
| 4,402,188 | 9/1983 | Skala | 165/18 X |
| 4,438,367 | 3/1984 | Kerns et al. | 315/5.41 |
| 4,490,648 | 12/1984 | Lancaster et al. | 315/5.41 |
| 4,494,040 | 1/1985 | Moretti | 315/5.41 |
| 4,494,184 | 1/1985 | Crevel | 165/30 X |
| 4,712,042 | 12/1987 | Hamm | 328/233 X |

FOREIGN PATENT DOCUMENTS

| | | | |
|---|---|---|---|
| 1077550 | 12/1984 | U.S.S.R. | 328/233 |

*Primary Examiner*—Eugene R. Laroche
*Assistant Examiner*—Senry Ham
*Attorney, Agent, or Firm*—Ray G. Wilson; Paul D. Gaetjens; William R. Moser

[57] ABSTRACT

A cooling system is provided for maintaining a preselected operating temperature in a device, which may be an RFQ accelerator, having a variable heat removal requirement, by circulating a cooling fluid through a cooling system remote from the device. Internal sensors in the device enable an estimated error signal to be generated from parameters which are indicative of the heat removal requirement from the device. Sensors are provided at predetermined locations in the cooling system for outputting operational temperature signals. Analog and digital computers define a control signal functionally related to the temperature signals and the estimated error signal, where the control signal is defined effective to return the device to the preselected operating temperature in a stable manner. The cooling system includes a first heat sink responsive to a first portion of the control signal to remove heat from a major portion of the circulating fluid. A second heat sink is responsive to a second portion of the control signal to remove heat from a minor portion of the circulating fluid. The cooled major and minor portions of the circulating fluid are mixed in response to a mixing portion of the control signal, which is effective to proportion the major and minor portions of the circulating fluid to establish a mixed fluid temperature which is effective to define the preselected operating temperature for the remote device. In an RFQ environment the stable temperature control enables the resonant frequency of the device to be maintained at substantially a predetermined value during transient operations.

16 Claims, 3 Drawing Sheets

RFQ ACCELERATOR TUNING SYSTEM

This invention is the result of a contract with the Department of Energy (Contract No. W-7405-ENG-36).

BACKGROUND OF THE INVENTION

This invention relates to heat removal devices and, more particularly, to heat removal devices which maintain preselected temperature conditions under variable heat input loads.

There are many applications where a constant temperature must be maintained through changes in operating conditions and heat removal requirements. One such device is a radio-frequency quadrupole (RFQ) accelerator in the production of high-energy particle beams. The basic function of the RFQ accelerator is to combine the focusing characteristics of a chain of alternatively rotated quadrupole lenses with the accelerating characteristics of a chain of rf cavities of graded spacing, converting a moderately diverging low-energy input beam into a well-collimated high-energy output beam. A typical RFQ accelerator structure is a quasi-cylindrical hollow steel shell, the inside of which is fitted with four copper-clad longitudinal vanes spaced 90° apart and extending radially inward from the interior shell wall. Longitudinal bore holes may be provided through which water or other fluids are circulated to remove from the Vanes and shell the excess heal generated by residual beam losses and large rf currents flowing in the skin-depth layer of the interiorly facing metal walls. One conventional RFQ accelerator operates with an rf driving power of up to 530 kW. much of Which must be removed as heat.

Conventionally, the four RFQ vanes extend radially inward almost to the central Z-axis of symmetry, with the adjacent vane edges remaining separated from each other by a small gap, which is typically a few millimeters. In order to produce the required acceleration of the beam particles, the inner edge of each RFQ vane is smoothly serrated in the longitudinal direction, approximating a sine wave of gradually increasing wavelength in the +.z direction, i.e., in the direction of beam travel. In the x- and y-planes, the transverse valleys in the two opposing vane edges are positioned opposite each other in longitudinal agreement. However, the x-plane valleys are opposite the y-plane hills in the final assembly.

In view of the precise vane edge alignments which are required, it is apparent that the RFQ accelerator cannot operate effectively with uncompensated temperature changes. For example, the thermal expansion coefficient is $9.4\times10^{-6}$ per ° F. for copper and $6.7\times10^{31\ 6}$ per ° F for steel. Given the narrow channel needed for strong electric fields across the beam, even small changes in temperature will change the intervane capacitance and significantly detune the cavities represented by the RFQ quadrants.

By way of example, in an RFQ accelerator having a Q-value of 8.500 and a resonant frequency of 425 MHz at 80° F., the corresponding half-power bandwidth is 50 kHz. and the thermal resonance detuning coefficient is −3.3 kHz per ° F. The amplitude and phase responses at the operating frequency will change accordingly as the resonant frequency shifts from the operating frequency. Even a 15° F. temperature deviation will reduce the amplitude response by 55% and shift the phase response by 63°.

One of the vane-edge design equations requires the serration wavelength to increase along the beam axis at a rate which is inversely proportional to the square of the product of the resonant frequency and the gap span. However, both the resonant frequency and the gap span vary inversely with temperature. Consequently, a simple retuning of the klystron driver frequency to compensate for a temperature-induced change in resonance will result in an undesirable departure from the spatio-temporal coherence needed for optimum operation of the RFQ accelerator. Retuning of the klystron driver also makes a combined RFQ/DTL (radio frequency quadrupole/drift tube linac) operation difficult, since the RFQ and DTL units generally have different responses to changes in beam loads and temperature.

The use of motorized tuning slugs or similarly movable internal elements to compensate for temperature changes in the RFQ accelerator results in undesirable disturbances of the electric fields needed across the vane gaps. Accordingly, it is seen that temperature stabilization of the RFQ resonant frequency is required. It would be desirable to obtain temperature stabilization by control of the temperature of the coolant circulating through the vane bore holes.

The temperature control problem is addressed by the present invention and improved methods and apparatus are provided for accurately stabilizing the temperature of a device under selected transient conditions.

Accordingly, an object of the present invention is to provide a system which will stably and accurately control the temperature of a remote thermal unit which is subject to unpredictable heat loads.

Another object of the present invention is to provide a method for controlling the temperature of a randomly perturbed remote thermal unit by diluting the flow of a main coolant fluid with a second coolant fluid of substantially lower temperature.

Still another object is to provide a stable and accurate temperature control system which automatically tunes the resonant frequency of a radio-frequency quadrupole accelerator to the fixed frequency of its UHF (ultra-high-frequency) driver, and maintains its resonant condition irrespective of unpredictable changes in the RFQ heat load.

One other object is to maintain a stable temperature in a device which is thermally remote from the temperature control system, wherein both thermal and transport lags must be considered.

SUMMARY OF THE INVENTION

To achieve the foregoing and other objects, and in accordance with the purposes of the present invention, as embodied and broadly described herein, the apparatus of this invention may comprise a thermal cooling system for maintaining a preselected operating temperature by circulating a fluid in a device having a variable heat removal requirement and which is remote from the cooling system. Means are provided for generating an estimated error signal from parameters indicative of the heat removal requirement. Sensors output temperature signals from predetermined locations in the cooling system. A first heat sink primarily removes heat from a major portion of the circulating fluid and a second heat sink removes heat from a minor portion of the circulating fluid. Mixing apparatus provides for mixing the major and minor portions of the circulating fluid to establish a temperature which is effective to define the preselected operating temperature for the remote device. A computer defines a control signal functionally related to the temperature signals and to the estimated error signal for returning the device to the preselected operating temperature in a stable manner. A control apparatus is responsive to a mixing portion of the control signal and is effective to actuate the mixing apparatus for establishing a control temperature for the minor portion of the circulating fluid.

In another characterization of the present invention, a process provides for maintaining a preselected operating temperature in a device having a variable heat removal requirement and which is remote from the cooling system. An estimated error signal is generated from parameters indicative of the heat removal requirement and temperature signals are output from predeterminated locations in the cooling system. Heat is removed from a major portion of the circulating fluid and heat is also removed from a minor portion of the circulating fluid. A control signal is defined to functionally relate to the temperature signals and the estimated error signal for returning the device to the preselected operating temperature in a stable manner. The major and minor portions of the circulating fluid are mixed in response to a mixing portion of the control signal to establish a temperature effective to define the preselected operating temperature for the remote device.

In another characterization of the present invention. a process is provided for tuning the resonant frequency of an RFQ accelerator into phase-locked coherence with the fixed ultra-high frequency output of its associated klystron driver in response to changes in the RFQ beam load. A cooling fluid is circulated through vanes comprising the RFQ accelerator. The temperature of the cooling fluid is controlled in a manner effective define the resonant frequency.

BRIEF DESCRIPTION OF THE DRAWINGS

The accompanying drawings, which are incorporated in and form a part of the specification, illustrate the embodiment of the present invention and, together with the description, serve to explain the principles of the invention. In the drawings.

DETAILED DESCRIPTION OF A PREFERRED EMBODIMENT

In accordance with the present invention, a temperature control system is provided which enables control algorithms to be defined to generate output control signals effective to stably maintain an operating temperature within narrow predetermined limits under standard operating transients. It is a particular feature herein that the temperature control system is remote from the device under control and the control algorithms must accommodate a significant time lag for various operating conditions. temperature sensors provide input data from selected system locations. The device whose temperature is being controlled generates an appropriate temperature error signal and a coolant-equivalent temperature rise signal indicative of the power to be removed by the coolant. As herein described, the system components are selected from commercially available items and the data processing requires only conventional analog and digital devices with standard mathematical processing capabilities.

Figure 1:
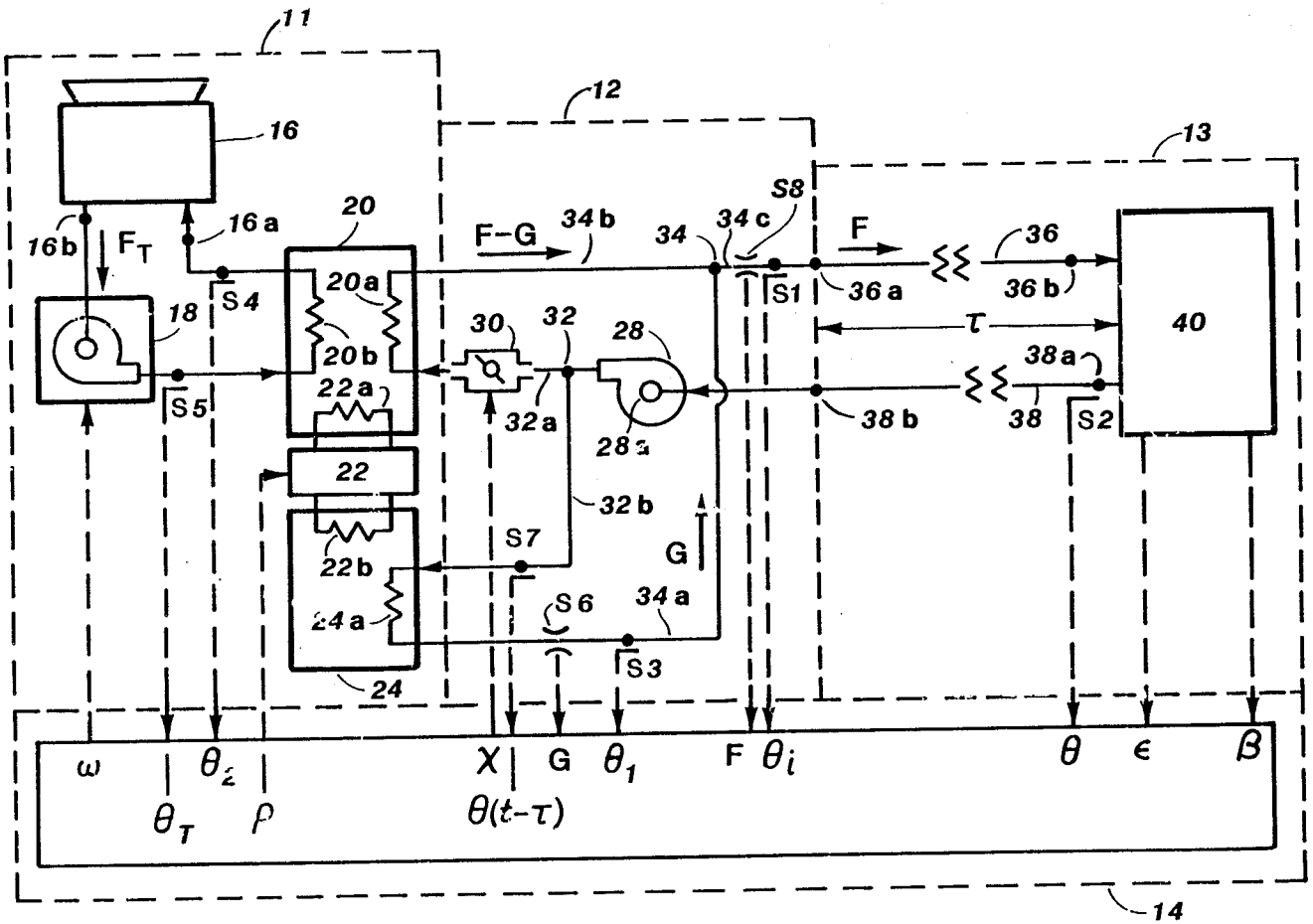
FIG. 1 is a schematic, in block diagram form, of an apparatus according to one embodiment of the present invention.

Referring now to FIG. 1, it is seen that the temperature control system is represented by four major sections: tank section 11, mixer section 12, load section 13 and control section 14. Tank section 11 includes cooling tower 16, variable-speed pump 18, cool-fluid tank 20, heat pump 22, and cold-fluid tank 24. Mixing section 12 includes constant-flow pump 28, variable flow constrictor 30, and two fluid-conduit tee-junctions 32 and 34. Load section 13 includes the device 40 whose temperature is to be controlled and its associated coolant inflow and outflow conduits. 36 and 38, respectively, each insulated and each of substantial length. Control section 14 is generally conventional analog and digital electronic devices arranged to receive. process, and transmit the various sensor and control signals.

Referring more specifically to load section 13, the coolant fluid in inflow and outflow conduits 36 and 38 has a constant flow rate. F. from constant-flow pump 28. There is a transport time lag, for fluid transport each way through the conduits. At inlet **36*a* to inflow conduit 36 the fluid temperature is $\theta_i(t)$, and at inlet 36*b* to device 40, the fluid temperature is $\theta_i(t-\tau)$. Similarly, at outlet 38*a* from device 40 the fluid temperature is 8(t), and at the outlet 38*b* of L outflow conduit 38 to mixing section 12**, the fluid temperature is $\theta(t-\tau)$.

Device 40, plus an estimated half of the inflow conduit 36, has a coolant-equivalent volume. V. With adequate perfusion, the coolant temperature $\theta(t)$ at outlet **38*a* is an accurate representation of the operating temperature of device 40. The coolant volume, V, in device 40** is replaced at a time constant $$T=V/F. \tag{1}$$

If the heating power P to be extracted from device 40 is steady, its perfusing coolant fluid will experience a corresponding steady-state temperature rise, giving the equation.

$$\alpha=P/cF. \tag{2}$$

in which c is the coolant specific heat. In the more general case where the heating power, P, varies more rapidly with time t the accelerator temperature. $\theta$, obeys the differential equation $$T\frac{d\theta}{dt}+\theta=\theta_i(t-\tau)+\alpha(t) \tag{3}$$

in which $\alpha(t)$ is given by equation (2)

As hereinbelow described, device 40 is represented by an RFQ accelerator. However, the error and response functions can be determined for other devices and used with the control system and algorithms presented, and no limitation is intended by the selection of an RFQ accelerator. An RFQ accelerator using the described cooling system does have enhanced operating characteristics with stable operation about the resonant frequency of the quadrupole. Tables 1 and 2 define the symbols used herein and representative operating values are provided for application to an RFQ accelerator. At the radio-frequency input terminal of RFQ accelerator 40 the phase-angle difference between the sinusoidal input voltage and current waveforms is a measure of the deviation of the actual accelerator temperature, $\theta$, from the ideal temperature. $\theta_R$, at which the accelerator is resonant. In the system of FIG. 1, accelerator 40 may be fitted with a radio-frequency phase detector and an associated signal conditioning module for defining a temperature error signal e of the sinusoidal form $$\epsilon = \epsilon_1 \cdot \text{Tanh} \frac{\theta - \theta_R}{\epsilon_1}. \quad (4)$$

Also, for the purpose of furnishing a fast anticipatory signal, approximating the coolant-equivalent temperature rise $\alpha$, accelerator 40 may be internally fitted with an electronic module having inputs representative of the radio-frequency input power, the beam input power, and the beam output power to rapidly determine the power, P, which is to be removed by the coolant flow. The calculated power, P, is used in Equation (2) to obtain an approximate coolant-equivalent temperature rise, $\beta$, where

TABLE 1

Temperature Symbols and Typical Values

| Symbol | Definition | Representative Value (°F.) |
|---|---|---|
| $\theta_T$ | Tower Outflow Temperature | 45 to 105 |
| $\theta_2$ | Cool-Tank Temperature | 50 to 110 |
| $\theta_1$ | Cold-Tank Temperature | 40 to 100 |
| $\theta_S$ | Spread Between $\theta_1$ and $\theta_2$ | 10 |
| $\Delta$ | Flow-Diluted Value of $\theta_S$ | 0.5 |
| $\theta_i$ | Load-Section Inflow Temperature | 50 to 110 |
| $\theta$ | Accelerator Operating Temperature | 50 to 110 |
| $\theta_R$ | Accelerator Resonant Temperature | 50 to 110 |
| $\alpha$ | Accelerator Coolant Temperature Rise | 0 to 0.5 |
| $\beta$ | Sensor-Estimated Value of $\alpha$ | 0 to 0.5 |
| $\epsilon$ | Phase-Detected Temperature Error | −0.5 to 0.5 |
| $\epsilon_1$ | Detector Scaling Value for $\epsilon$ | 0.5 |
| $\epsilon_0$ | Initial Value of $\epsilon$ | −0.5 to 0.5 |

TABLE 2

Other Symbols and Typical Values

| Symbol | Description | Representative Value | Units |
|---|---|---|---|
| $\tau$ | Load-Unit Transport Lag | 15 | Sec |
| T | Load-Unit Time Constant | 17 | Sec |
| $T_1$ | Imposed Cold-Tank Time Constant | 170 | Sec |
| $T_2$ | Imposed Cool-Tank Time Constant | 180 | Sec |
| V | Load-Unit Fluid Volume | 54 | Gal |
| $V_2$ | Cool-Tank Fluid Volume | 69 | Gal |
| $V_1$ | Cold-Tank Fluid Volume | 27 | Gal |
| F | Load-Unit Perfusion Rate | 191 | Gpm |
| G | Cold-Tank Perfusion Rate | 0 to 9.5 | Gpm |
| $G_m$ | Maximum Value of G | 9.5 | Gpm |
| $\chi$ | Cold Metering Signal | 0 to 1 | — |
| $F_T$ | Tower Perfusion Rate | 0 to 23 | Gpm |
| $F_m$ | Maximum Value of $F_T$ | 23 | Gpm |
| w | Tower Metering Signal | 0 to 1 | — |
| P | Accelerator Heat Load | 0 to 14 | kW |
| c | Coolant Specific Heat | 8800 | J/Gal./°F. |
| K | Cold Tank Refrigeration | 0 to 14 | kW |
| $K_m$ | Maximum Value of K | 14 | kW |
| $\rho$ | Heat Pump Control Signal | 0 to 1 | — |
| n | Performance Coefficient | 5 | — |

$$\beta \simeq \alpha. \quad (5)$$

Methods for designing sensors having output characteristics specified by equations (4) and (5) are well known in the electronics art and are not described in detail herein.

Referring now to mixer section 12, it is seen that conduit outlet port 38b from load section 13 is connected to input port 28a of pump 28, and that conduit inlet port 36a to load section 13 is connected to outlet port 34c of tee-junction 34. The output of pump 28 is fed to tee-junction 32, one output of which 32a is connected to the input of flow-constrictor 30. The remaining output 32b of tee-junction 32 s connected to the input of heat-exchange coil 24a in cold tank 24 of tank section 11. The output of flow-constrictor 30 is connected to the input of another heat-exchange coil 20a in cool tank 20 of tank section 11. An input 34a to tee-junction 34 is connected to the output of first heat-exchange coil 24a. The other input 34b is connected to the output of second heat-exchange coil 20a.

Referring still to section 12 of FIG. 1, the function of pump 28 is to maintain a constant flow rate. F. Due to the mild obstructive action of flow-constrictor 30, a relatively minor portion. G, of the total flow. F. is diverted through outlet port 32b of tee-junction 32. Flow-constrictor 30 may have the general form of an electrically operated fast-response proportional throttling valve which does not need to constrict its main flow by more than a few percent. In particular, constrictor 30 may simply be a short length of fluid conduit into which is inserted a perforated vane mounted on a motorized shaft which is tilted in proportion to an electrical input signal.

Taking into consideration the separate flow resistances of the parallel fluid paths through the two heat-exchange coils 20a and 24a. and also the relative fluid-entrainment actions inside tee-junctions 32 and 34, the action of flow out of constrictor 30 is arranged so that the rate of flow. G. through heat exchange coil 24a is in accord with the equation $$G = G_m \cdot \chi, \quad (6)$$

which $0 \leqq \chi \leqq 1$ is the dimensionless flow-control signal and $G_m$ is the maximum flow to be diverted.

Cool tank 20 has an outlet temperature $\theta_2$, and cold tank 24 has an outlet temperature $\theta_1$. As a result of the action of mixer section 12, the temperature $\theta_i$ of the mixed coolant in tee-junction outlet 34c is defined by the control equation $$\theta_i = \theta_2 - \frac{Gm}{F} \cdot (\theta_2 - \theta_1) \cdot \chi. \quad (7)$$

A temperature spread $$\theta_s = \theta_2 - \theta_1 \quad (8)$$

is defined. The various conduits in mixer section 12 are made short enough that their heat losses and transport time lags are negligible. As hereinafter explained, the temperature $\theta_2$ of cool tank 20 will be held equal to the accelerator resonant temperature, $\theta_R$.

Referring now to tank section 11 of FIG. 1, it is seen that condenser coil 22a in tank 20, evaporator coil 22b in tank 24, and heat pump 22 are arranged to transfer heat from tank 24 and into tank 20. Also, by means of the heat-uptake coil 20b insulated conduits 16a and 16h. and variable-speed fluid pump 18, heat is transferred from tank 20 to cooling tower 16, where it is dumped to the atmosphere.

BY use of standard proportional-drive techniques, heat pump 22 is arranged so that the rate. K, of heat extraction from tank 24 by the evaporator coil 22b is given by the formula $$K = K_m \cdot \rho, \quad (9)$$

in which $0 \leqq \rho \leqq 1$ is the dimensionless heat pump control signal, and Km may typically be equal to the maximum power to be dissipated from accelerator 40. Then, with the fluid connections shown in section 11, the temperature $\theta_1$ of cold tank 24 is governed by the differential equation $$c\, V_1 \frac{d\theta_1}{dt} = c \cdot G \cdot [\theta(t - \tau) - \theta_1] - K, \quad (10)$$

in which G and K are defined by equations (6) and (9), and $V_1$ is the coolant-equivalent volume of tank 24.

Fluid pump 18 is arranged to produce a flow rate, $F_T$. where $$F_T = F_m - w, \quad (11)$$

where $F_m$ is a maximum flow rate and $0 < w \leqq 1$ is the dimensionless pump-speed control signal.

temperature $\theta_2$ of cool tank 20 is governed by the differential equation $$C\, V_2 \frac{d\theta_2}{dt} = c \cdot (F - G) \cdot [\theta(t - \tau) - \theta_2] - c \cdot F_T \cdot (\theta_2 - \theta_T) + \left(1 + \frac{1}{n}\right) \cdot K, \quad (12)$$

in which G, K, and $F_T$ are defined by equations (6), (9). and (11). $\theta_T$ is the temperature of the coolant entering the heat-uptake coil 20b and $V_2$ is the coolant equivalent volume of tank 20. By use of an ordinary thermostatic fluid-bypass valve in cooling tower 16, and auxiliary fluid heating means if necessary, the tower exit temperature $\theta_T$ is typically held at a level about equal to $)\theta_R - \theta_S/2)$.

Referring now to control section 14, the heat-pump control signal is generated by computational system 14, which may include a first AD/DA interfaced microprocessor using as inputs the temperature signals $\theta_1$ and $\theta_2$ from sensors S3 and S4, respectively, along with a signal representative of the fluid flow rate. G. derived from sensor S6 at the exit of heat exchange coil 24a, and a signal representative of the delayed accelerator temperature $\theta(t-\tau)$ from sensor S7 at the inlet to heat exchange coil 24a. The control signal $\tau$ is defined herein by the equation $$\rho = \frac{cG_m}{K_m} \cdot \left\{ \frac{G}{G_m} [\theta(t - \tau) - \theta_1] + \theta_1 - \theta_R + \theta_S \right\}, \quad (13)$$

with the aid of equation (9), converts equation (10) into the form $$T_1 \frac{d\theta_1}{dt} + \theta_1 = \theta_R - \theta_S, \quad (14)$$

where $T_1$ is defined as the time constant $$T_1 = \frac{V_1}{G_m}. \quad (15)$$

In an analogous manner, control signal w for variable-speed pump 18 is generated by computational system 14, which may include a second AD/DA interfaced microprocessor using as inputs the heat pump control signal $\tau$, specified by equation (13), temperature signal $\theta_T$ from sensor S5, temperature signals $\theta_2$ and $\theta(t-\tau)$, and the two signals representative of the fluid flow rates. F and G. Control signal w is defined herein by the equation $$w = \frac{(F - G)}{F_m} \cdot \frac{[\theta(t - \tau) - \theta_2]}{(\theta_2 - \theta_T)} + \frac{(\theta_2 - \theta_R)}{(\theta_2 - \theta_T)} + \frac{(n + 1) \cdot K_m \cdot \rho}{(\theta_2 - \theta_T) \cdot ncF_m}, \quad (16)$$

which converts equation (12) into the form $$T_2 \frac{d\theta_2}{dt} + \theta_2 = \theta_R, \quad (17)$$

where $T_2$ is defined as the time constant $$T_2 = \frac{V_2}{F_m}. \quad (18)$$

Given the heat pump control signal as defined by (13) and the fluid pump speed control signal w as defined by equation (16). it is seen from inspection of equations (14) and (17) that the cool-tank temperature will always be directed toward the predetermined accelerator resonant temperature. $\theta_R$, and that the cold-tank temperature. 74 1, will always be directed toward a lower temperature $(\theta_R - \theta_S)$.

Protection against inaccuracies of implementing equation (13) can be realized by replacing the $(\theta_R - \theta_X)$ term in equation (13) with $(\theta_R - \theta'_S)$, where $$(\theta_R' - \theta_S') = (\theta_R - \theta_S) + \frac{1}{4T_1}\int_o^t [(\theta_R - \theta_S) - \theta_1]dt. \quad (19)$$

Similarly, protection against inaccuracies of implementing equation (16) can be realized by replacing the $\theta_R$ term in equation (16) with $\theta''_R$, where $$\theta_R'' = \theta_R + \frac{1}{4T_2}\int_o^t (\theta_R - \theta_2)dt. \quad (20)$$

irrespective of the modifications described by equations (19) and (20), the net result of the algorithms specified by equations (13) and (16) operating on the control parameters obtained by the present system is to produce a pair of simplified control equations (14) and (17) for the cold-tank and cool-tank temperatures $\theta_1$ and $\theta_2$.

As shown in FIG. 1, control section 14 is arranged to perform three major functions. A first function is the generation of the previously discussed heat pump 22 output sensor-generated input signals [$\theta$, $\theta(t-\tau)$, G], as set out in equation (13) and optionally modified by equation (19). A second major function is the generation of the pump 18 control signal, w, using both the output signal $\tau$ and the collection of sensor-generated input signals [$\theta_2$, $\theta(t-\tau)$, $\theta_T$, F, G], as set out in equation (16) and optionally modified by equation (2-0).

The third major function of control section 14 is to receive the collection of sensor-generated input signals [$\theta_1$, $\theta_2$, F, $\epsilon$, $\beta$] and, by means of a third AD/DA interfaced microprocessor, generate the output control signal $\chi$, defined by the formula $$\chi = \frac{F/G_m}{(\theta_2 - \theta_1)}\cdot\left[(\theta_2 - \theta_R) + \beta + \frac{\tau\epsilon}{4T} + \frac{1}{4T}\int_o^t \epsilon\, dt\right], \quad (21)$$

which converts equation (7) into the form $$\theta_i(t) = \theta_R - \left[\beta + \frac{\tau\epsilon}{4T} + \frac{1}{4T}\int_o^t \epsilon\, dt\right]. \quad (22)$$

The purpose of the term $(\theta_2-\theta_1)$ rather than $\theta_S$, and $(\theta_2-\theta_R)$ rather than zero, in equation (21) is to make equation (22) insensitive to offset and transient errors in the equalities $\theta_2=\theta_R$ and $\theta_1=\theta_R-\theta_S$, which are sought by use of equations (13), (16), (19), and (20) to regulate the cool-tank and cold-tank temperatures, $\theta_2$ and $\theta_1$, respectively.

The effectiveness of equation (21) as the final control algorithm will be seen by first noting that, for small deviations of the accelerator temperature $\theta$ from reduce value, $\theta_R$, the sigmoid equation (4) reduces to the linear form $$\epsilon=\theta-\theta_R. \quad (23)$$

The substitution of equations (22) and (23) into equation (3), and taking the Laplace transform, where $\bar{\alpha}(S)$, $\bar{\beta}(S)$, $\bar{\epsilon}(S)$ denote the Laplace transforms of $\alpha(t)$. $\beta(t)$, and $\epsilon(t)$, gives $$\bar{\epsilon} = \frac{[T\epsilon_o + (\bar{\alpha} - \bar{\beta}\, e^{-\tau s})]\cdot 4Ts}{4T^2s^2 + 4Ts + (\tau s + 1)\cdot e^{-\tau s}}, \quad (24)$$

in which $\epsilon_0$ is the initial value of $\epsilon$. The corresponding time-domain equation for $\epsilon(t)$ is $$T\dot{\epsilon} + \epsilon = \alpha - \left[\beta + \frac{\tau\epsilon}{4T} + \frac{1}{4T}\int_o^t \epsilon\, dt\right]_{t-\tau}, \quad (25)$$

in which $\dot{\epsilon}$ is the derivative of e with respect to time, t, and in which $\alpha$ and $\beta$ may vary with time.

Figure 2:
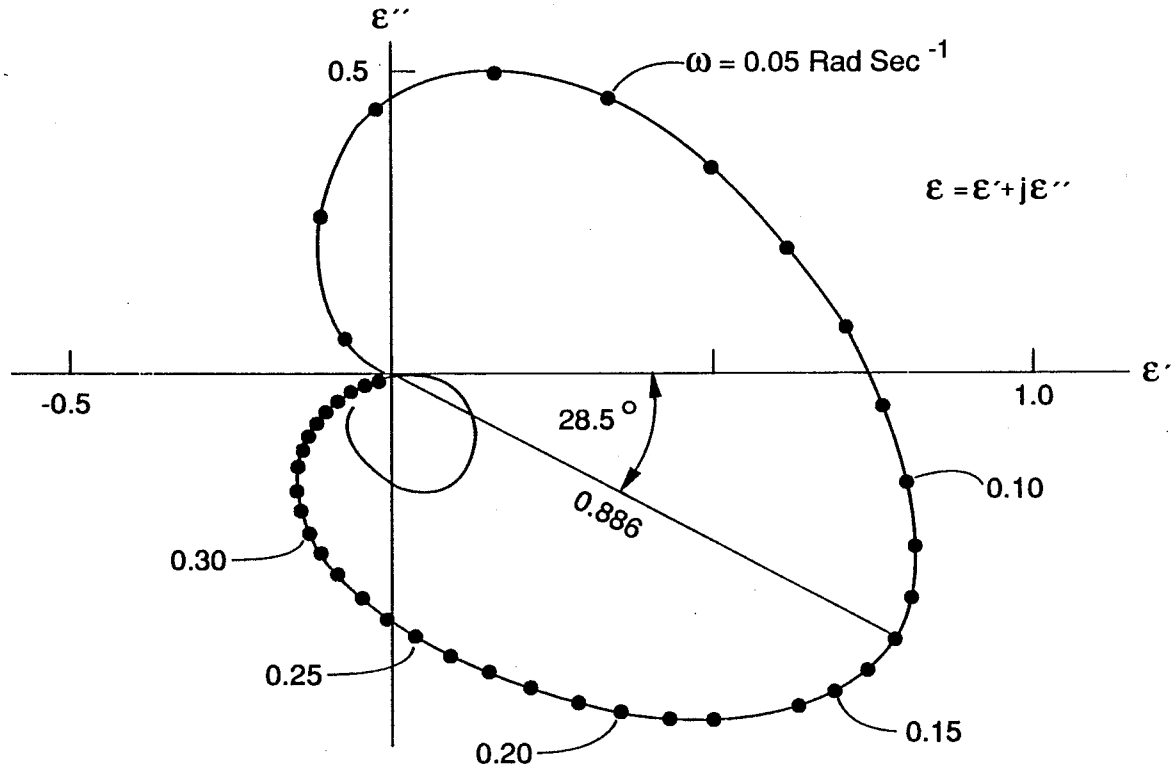
FIG. 2 is a graph of the response in the phase-plane illustrating the stable performance of a particular embodiment of the present invention.

The stability of the overall system of FIG. 1 over a wide range of disturbance frequencies for representative RFQ accelerator parameters is demonstrable from equation (24) by first setting $\epsilon_{e0}=0$, $s=j\omega$, $\beta=\alpha=1$. $\tau=15$ sec and T=17 sec, and then plotting $\epsilon$ in the complex phase plane as a function of as shown in FIG. 2. The resulting curve shows that even with the maximum 7±7 kW, 0.02 Hz heat-load disturbance (for which $\alpha=0.25\pm0.25$ sin 0.13t) the RFO temperature error $\epsilon$ will remain within the range of $-0.22\leqq\epsilon\leqq0.22°$ F.

Figure 3:
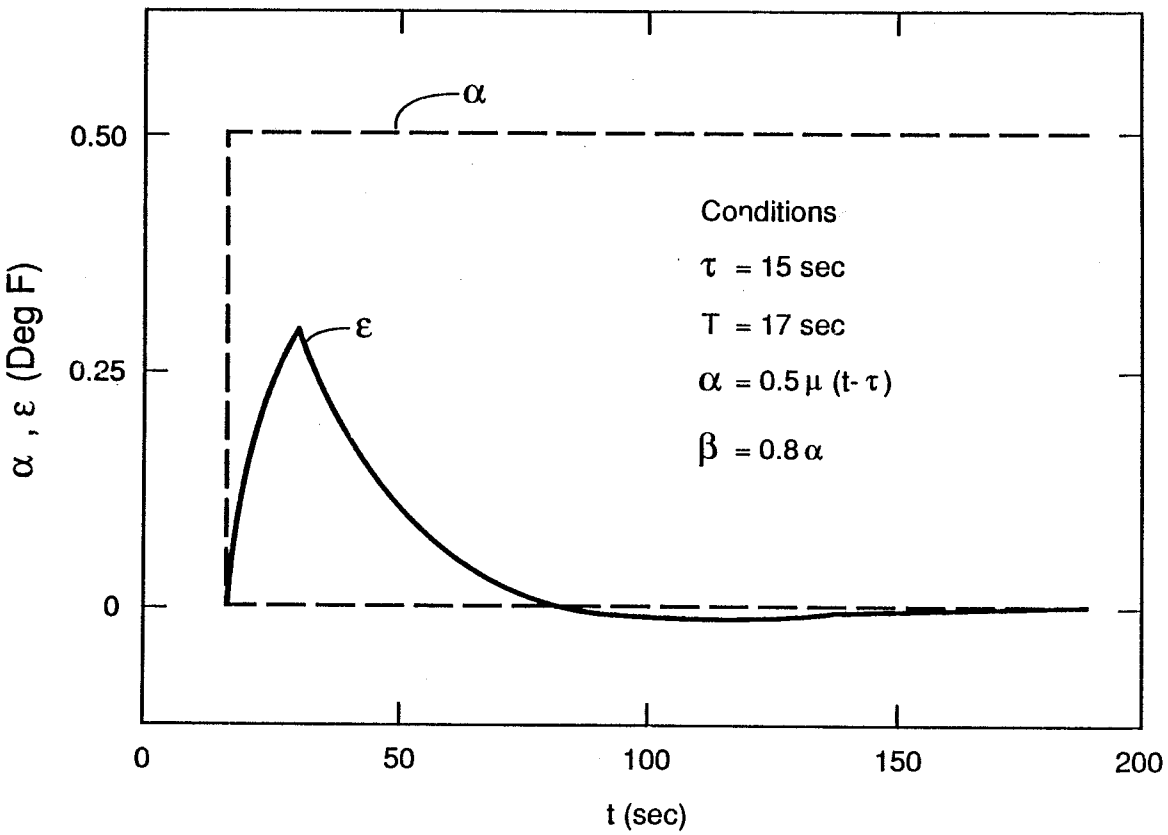
FIG. 3 illustrates the response of an illustrative embodiment of the present invention to a step increase in the portion of the beam power to be dissipated.

The response of the overall system of FIG. 1 to a sudden large increase in an imperfectly sensed heat load is demonstrable from equation (25) by first setting $\tau=15$ sec, T=17 sec, $\beta=0.8\ \alpha$, and $\epsilon_0=0$, and then plotting $\epsilon(t)$ in response to the full-scale step function $\alpha=0.5\ u(t-\tau)$, as shown in FIG. 3. The resulting curve shows that the RFQ temperature error, $\epsilon$, rises to a peak value of 0.28° F. during the time lag, $\tau$ after which the automatic corrective action reduces the temperature error to less than 0.05° F. within a time span of no more than 30 sec.

Numerous variations in the above-described system can be made without departing from the essential concepts of this invention. For example, the exact shaping of the flow constrictor 30 can be made independent of the fluid flow-path resistances by inserting a flow sensor in the tee-junction output line **32*b* and using the detected flow rate, G, as a local feedback signal. Alternatively, flow constrictor 30 may be removed if a variable-speed fluid pump is inserted in tee-junction outflow line 32*b*. Another modification, for use in the case where a given change in the RFQ heating power is known in advance, could be the insertion of another term in the right-hand side of equation (21) in order to provide a corresponding early change in the control signal $\chi$ for the mixed coolant temperature $\theta_i$. Still further, in cases where the accelerator resonant temperature $\theta_R$ is well above the ambient atmospheric temperature, cooling tower 16 and its associated fluid pump 18 and heat uptake coil 20*b* might be eliminated in favor of a set of fins and a variable-speed air-blower installed on the external surface of cool tank 20**.

The foregoing description of the preferred embodiment of the invention has been presented for purposes of illustration and description. It is not intended to be exhaustive or to limit the invention to the precise form disclosed, and obviously many modifications and variations are possible in light of the above teaching. The embodiment was chosen and described in order to best explain the principles of the invention and its practical application to thereby enable others skilled in the art to best utilize the invention in various embodiments and with various modifications as are suited to the particular use contemplated. It is intended that the scope of the invention be defined by the claims appended hereto.

What is claimed is:

1. A cooling system for maintaining a preselected operating temperature by circulating a fluid in a device having a variable heat removal requirement and remote from said cooling system, comprising:

means for generating an estimated anticipatory error signal from parameters indicative of said heat removal requirement;

sensor means for outputting temperature signals from predetermined locations in said cooling system;

computational means defining a control signal functionally related to said temperature signals and said estimated error signal for returning said device to said preselected operating temperature in a stable manner;

a first heat sink responsive to a first portion of said control signal for removing heat from a major portion of said circulating fluid;

a second heat sink responsive to a second portion of said control signal for removing heat from a minor portion of said circulating fluid;

means for mixing said major and minor portions of said circulating fluid; and mixing means responsive to a mixing portion of said control signal effective to proportion said major and minor portions of said circulating fluid wherein said mixing means establishes a mixed fluid temperature effective to define said preselected operating temperature for said remote device.

2. A cooling system according to claim 1, wherein said mixing means includes a flow control valve responsive to said mixing portion of said control signal for diverting said minor portion of said circulating fluid through said second heat sink.

3. A cooling system according to claim 1, wherein said first heat sink includes first controllable heat transfer means for transferring heat to an external environment.

4. A cooling system according to claim 1, wherein said second heat sink includes second controllable heat transfer means for transferring heat to said first heat sink.

5. A cooling system according to claim 3, wherein said second heat sink includes second controllable heat transfer means for transferring heat to said first heat sink.

6. A cooling system for maintaining a preselected operating temperature by circulating a fluid in a quadrupole accelerator having a variable heat removal requirement and remote from said cooling system, comprising:

means for generating an estimated error signal from parameters indicative of said heat removal requirement and functionally related to a difference between a first temperature at which said accelerator has a predetermined resonant frequency and a second temperature functionally related to a current operating temperature of said quadrupole;

sensor means for outputting temperature signals from predetermined locations in said cooling system;

computation means defining a control signal functionally related to said temperature signals and said estimated error signal for returning said device to said preselected operating temperature in a stable manner;

a first heat sink responsive to a first portion of said control signal for removing heat from a major portion of said circulating fluid;

a second heat sink responsive to a second portion of said control signal for removing heat from a minor portion of said circulating fluid;

means for mixing said major and minor portions of said circulating fluid; and valve means responsive to a mixing portion of said control signal effective to proportion said major and minor portions of said circulating fluid wherein said mixing means establishes a mixed fluid temperature effective to define said preselected operating temperature for said quadrupole.

7. A cooling system according to claim 6, wherein said mixing means includes a flow control valve responsive to said mixing portion of said control signal for diverting said minor portion of said circulating fluid through said second heat sink.

8. A cooling system according to claim 6, wherein said first heat sink includes first controllable heat transfer means for transferring heat to an external environment.

9. A cooling system according to claim 6, wherein said second heat sink includes second controllable heat transfer means for transferring heat to said first heat sink.

10. A cooling system according to claim 8, wherein said second heat sink includes second controllable heat transfer means for transferring heat to said first heat sink.

11. A process for maintaining a preselected operating temperature in a device having a variable heat removal requirement and remote from said cooling system, comprising the steps of:

generating an estimated anticipatory error signal from parameters indicative of said heat removal requirement;

outputting temperature signals from predetermined locations in said cooling system;

defining a control signal functionally related to said temperature signals and said estimated error signal for returning said device to said preselected operating temperature in a stable manner;

removing heat from a major portion of said circulating fluid in response to a first portion of said control signal;

removing heat from a minor portion of said circulating fluid in response to a second portion of said control signal; and mixing said major and minor portions of said circulating fluid in response to a mixing portion of said control signal to establish a temperature effective to define said preselected operating temperature for said remote device.

12. A process according to claim 11, further including the step of regulating a flow control valve for diverting said minor portion of said circulating fluid for said heat removal from said minor portion.

13. A process according to claim 11, including the step of controlling said transfer of heat from said major portion to an external environment.

14. A process according to claim 11, including the step of controlling said transfer of heat from said minor portion to a first heat sink for removing heat from said major portion.

15. A process according to claim 11, wherein said device is a quadrupole accelerator and said error signal is functionally related to a difference between a first temperature at which said accelerator has a predetermined resonant frequency and a second temperature functionally related to a current operating temperature of said quadrupole.

16. A process for maintaining the resonant frequency of a radio-frequency quadrupole (RFQ) accelerator at a predetermined value, comprising the steps of:

circulating a cooling fluid through said RFQ accelerator and a cooling system for controlling the temperature of said cooling fluid;

defining a cool tank temperature in said cooling system for removing heat from a major portion of said cooling fluid;

defining a cold tank temperature in said cooling system for removing heat rom a minor portion of said cooling fluid; and controllably mixing said major and minor portions of cooling fluid output from said cool and cold tanks, respectively, effective to return said cooling fluid to said RFQ at a temperature which is functionally related to said resonant frequency for said RFQ accelerator.

* * * * *